US005133853A

United States Patent [19]

Mattsson et al.

[11] Patent Number: 5,133,853

[45] Date of Patent: Jul. 28, 1992

[54] SEWAGE SYSTEM

[75] Inventors: Roland S. Mattsson, Sockbergetz; Pentti Marjanen, Röyuanrinne, both of Finland

[73] Assignee: Nesite Oy, Helsinki, Finland

[21] Appl. No.: 557,155

[22] Filed: Jul. 20, 1990

[51] Int. Cl.[5] ..... E03D 1/06

[52] U.S. Cl. ..... 210/104; 210/97; 210/98; 210/258; 210/259; 210/532.2; 4/321; 4/431

[58] Field of Search ..... 210/258, 259, 532.2, 210/257.1; 4/321, 431

[56] References Cited

U.S. PATENT DOCUMENTS

| | | | |
|---|---|---|---|
| 4,199,828 | 4/1980 | Hellers | 4/321 |
| 4,357,719 | 10/1982 | Badger et al. | 4/431 |
| 4,561,132 | 12/1985 | Lew et al. | 4/420 |
| 4,819,279 | 4/1989 | Sigler et al. | 4/300 |
| 4,955,091 | 9/1990 | Grills et al. | 4/321 |

FOREIGN PATENT DOCUMENTS

| | | |
|---|---|---|
| 63985 | 5/1983 | Finland . |
| 66670 | 7/1984 | Finland . |

*Primary Examiner*—Robert A. Dawson
*Assistant Examiner*—David Reifsnyder
*Attorney, Agent, or Firm*—Ladas & Parry

[57] ABSTRACT

The invention relates to a sewage system comprising a sewage producing unit, a vacuum creating apparatus, an intermediate tank, a receiver and pipe connection means interconnecting said parts. The sewage is arranged to be carried away from the sewage producing unit into the intermediate tank by means of vacuum. To minimize smell problems, exhaust air from the vacuum creating apparatus is arranged to be passed into a pressure accumulator. The compressed air stored in the pressure accumulator is arranged to be passed into the intermediate tank so that it passes the sewage contained in the intermediaate tank into the sewage receiver.

2 Claims, 1 Drawing Sheet

SEWAGE SYSTEM

Figure 1:
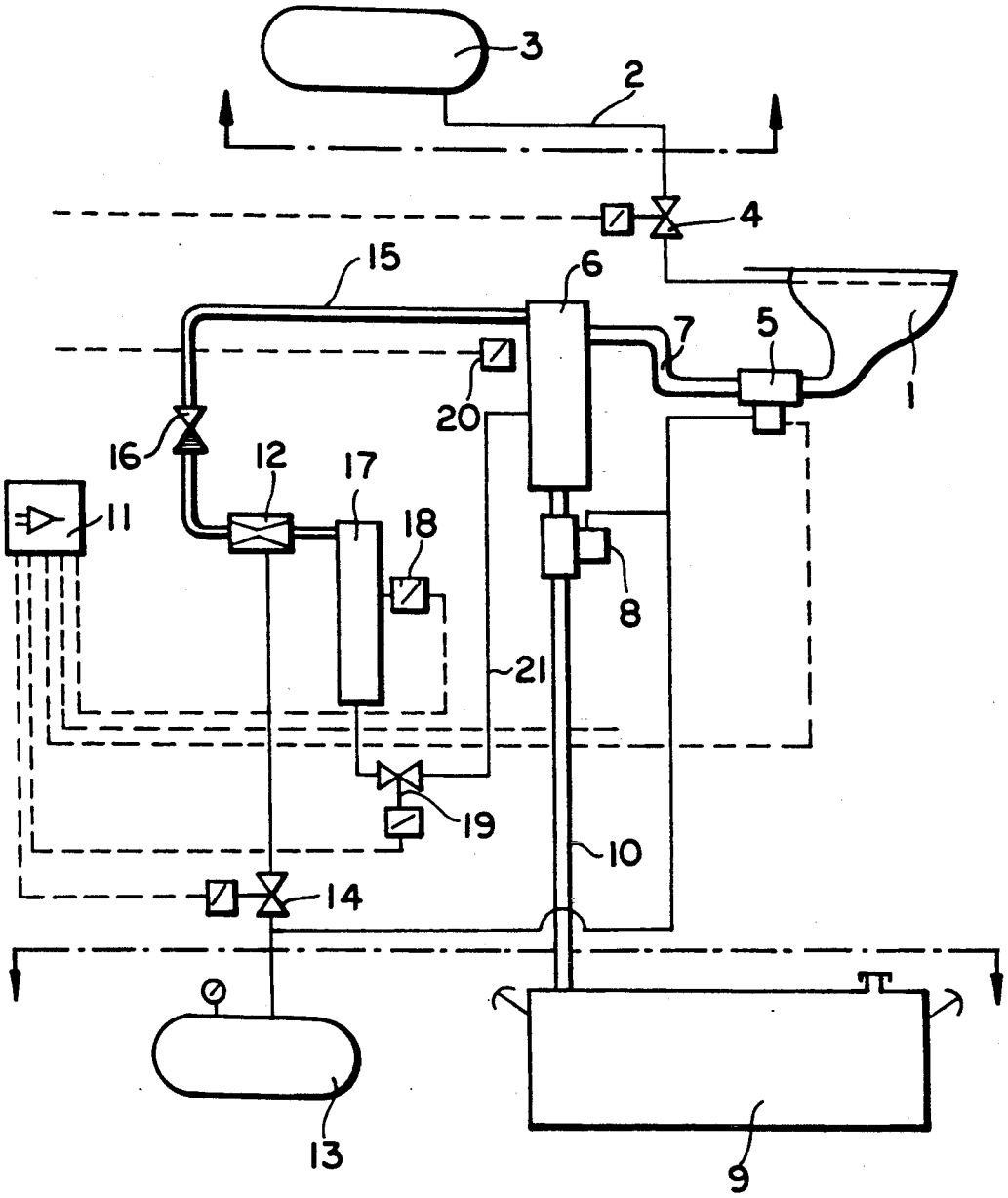

The invention relates to a sewage system comprising a sewage producing unit, a vacuum creating apparatus, an intermediate tank, a receiver, and pipe connection means interconnecting said parts, the sewage being arranged to be carried away from the sewage producing unit into the intermediate tank by means of vacuum.

So-called vacuum sewage systems in which the sewage is carried away by means of vacuum are today widely-used e.g. in different means of transportation such as airplanes, ships, trains and boats.

In sewage systems known from the prior art the sewage is carried away by means of either vacuum alone or by means of vacuum and the force of gravity. There are also systems which utilize the force of gravity and overpressure.

The prior art includes the sewage systems disclosed in FI Patent Specifications 63985 and 66670.

A drawback of prior art systems is that they take plenty of room because of the difficult positioning of the system components. A further drawback of prior art systems is their high consumption of compressed air as well as of flush water in many cases, and the smell problems caused by the exhaust air. One more frequent problem with prior art systems is the easily occurring backblow.

The object of the invention is to provide a sewage system by means of which the drawbacks of prior art systems can be eliminated. This is achieved by means of a sewage system of the invention, which is characterized in that exhaust air from the vacuum creating apparatus is arranged to be passed into a pressure accumulator and that the compressed air stored in the pressure accumulator is arranged to be passed into the intermediate tank so that it forces the sewage contained in the intermediate tank into the receiver.

An advantage of the invention is that it is simple, being as simple to install as the widely used system utilizing the force of gravity. A further advantage is that the system takes very little room, which is a major advantage in boats in particular. Furthermore, the consumption of flush water is low and the smell problems associated with the exhaust air can be minimized. Due to its simplicity, the system is advantageous to produce, install and use.

In the following the invention will be described by means of a preferred embodiment shown in the attached drawing, wherein the figure shows a general view of a sewage system of the invention.

The figure shows generally the sewage system of the invention. A sewage producing unit, in this case a toilet bowl, is indicated with the reference numeral 1. A flush water tank 3 is connected to the toilet bowl 1 by means of a pipe connection 2. The pipe connection 2 is provided with a flush valve 4 by means of which the connection between the flush water tank 3 and the toilet bowl 1 can be opened and closed.

In the figure the reference numeral 5 indicates an emptying valve and the reference numeral 6 an intermediate tank. The intermediate tank 6 and the toilet bowl 1 are interconnected by means of a pipe connection 7.

The reference numeral 8 indicates an exhaust valve and the reference numeral 9 a receiver. The intermediate tank 6 and the receiver 9 are interconnected by means of a pipe connection 10.

A control unit for the system is indicated in the figure by means of the reference numeral 11. A vacuum creating apparatus is indicated with the reference numeral 12, and a tank for compressed air with the reference numeral 13. A control valve for the vacuum creating apparatus 12 is indicated in the figure with the reference numeral 14. The vacuum creating apparatus 12 is connected to the intermediate tank by means of a pipe connection 15 and a unidirectional valve 16.

The reference numeral 17 indicates a pressure accumulator and the reference numeral 18 a monitor for the overpressure of the pressure accumulator. The pressure accumulator 17 is connected to the intermediate tank 6 by means of a pipe connection 21 and a blow valve 19. A monitor for the vacuum of the intermediate tank 6 is indicated with the reference numeral 20.

In principle, the system shown in the figure operates in the following way. The timing of the operation of the devices of the system is controlled by means of a microprocessor. When the flushing request is made by pressing a press button provided in connection with the control unit 11, the control means opens the flush valve 4 for a while, whereby a predetermined amount of water flows into the toilet bowl while the control means starts the vacuum creating apparatus 12, which may be e.g. a compressed air ejector, a vacuum pump or other similar apparatus. This operation is so timed that the vacuum creating apparatus 12 stops after a preset period of time. This period of time may be e.g. about 2 seconds. The vacuum creating apparatus 12 thus creates a vacuum in the intermediate tank 6 and in the pipe connection 7. Exhaust air from the vacuum creating apparatus is passed into the pressure accumulator 17. After the vacuum creating apparatus 12 has stopped, the emptying valve 5 opens, so that the pressure difference causes the sewage to be passed into the intermediate container 6. The emptying valve 5 is closed after the preset period of time, which may be e.g. about 1 to 2 seconds.

At the following stage the blow valve 19 is opened, which allows the passage of the compressed air contained in the pressure accumulator 17 into the intermediate tank 6. This is controlled by means of the pressure monitor in such a way that if the pressure does not rise in a predetermined manner, the blowing is stopped immediately and the operation of the toilet is interrupted. When the operation proceeds in the predetermined manner and the preset pressure value is reached in the intermediate tank, the blow valve 19 is closed and the exhaust valve 8 interconnecting the intermediate tank 6 and the receiver 9 is opened. The exhaust valve 8 is closed immediately after the predetermined pressure drop has occurred in the intermediate tank 6. This kind of operation is of essential importance because the amount of air discharged from the receiver into the atmosphere is at the most equal to the amount of sewage passed into the receiver, whereby the smell problems are minimized. After this operation the system is ready for a new operation cycle.

Essential in the invention is that the exhaust air from the vacuum creating apparatus is passed into the pressure accumulator, from which it is passed controlledly into the intermediate tank at the right time. The recycling of the exhaust air and the monitoring of the pressure level prevent the undesired backblow and the escape of an excessive amount of air into the atmosphere. In this way the smell problems are minimized and the consumption of compressed air is reduced.

The above embodiment is by no means intended to restrict the invention, but the invention can be modified within the scope of the claims as desired. Accordingly, it is obvious that the system or its parts need not be exactly similar to those shown in the figures but other solutions are possible as well. In place of a toilet bowl, the sewage producing unit may be a basin, for example. The different components of the system can be placed as desired. However, it has proved to be particularly advantageous to position all the required components within the outer case of a toilet unit, for instance, as the parts of the system of the invention can be fitted in a very small space so that the space requirement of the unit is substantially equal to that of a conventional system. An example of the space requirement of the system of the invention is that the distance over which the sewage is carried into the intermediate tank by means of vacuum may be very short, e.g. 20 to 30 cm in the horizontal or vertical direction.

We claim:

1. A sewage system comprising:

a sewage production unit;

an intermediate tank in fluid communication with said sewage production unit;

a vacuum creating means in fluid communication with said intermediate tank to cause sewage in said sewage production unit to be moved into said intermediate tank;

a receiver in fluid communication with said intermediate tank;

a pressure accumulator in fluid communication with said vacuum creating means and said intermediate tank so that exhaust air from said vacuum creating means is compressed in said pressure accumulator and then discharged into said intermediate tank to expel the sewage contained in said intermediate tank into said receiver;

an exhaust valve in fluid communication with the intermediate tank and the receiver to regulate the flow of sewage from said intermediate tank into the receiver;

a pressure monitor operatively connected to the intermediate tank to measure the pressure in the intermediate tank; and a control unit operatively connected to said exhaust valve and said pressure monitor so that when said pressure monitor senses a predetermined pressure drop in said intermediate tank said exhaust valve is closed.

2. The sewage system according to claim 1, wherein said sewage production unit is a toilet bowl.

* * * * *